United States Patent [19]

Zunkel

[11] 4,115,897

[45] Sep. 26, 1978

[54] ZERO FORCE HOLD OPEN DOOR CLOSER

[75] Inventor: Richard L. Zunkel, Marshville, N.C.

[73] Assignee: Eaton Corporation, Cleveland, Ohio

[21] Appl. No.: 840,696

[22] Filed: Oct. 11, 1977

[51] Int. Cl.[2] ..... E05F 3/00

[52] U.S. Cl. ..... 16/49; 16/51; 16/62; 16/79

[58] Field of Search ..... 16/49, 79, 72, 82, 51, 16/52, 58, 62, 66, 69, 64, 71, 84

[56] References Cited

U.S. PATENT DOCUMENTS

| | | | |
|---|---|---|---|
| 3,574,886 | 4/1971 | Solovieff | 16/51 |
| 3,852,846 | 10/1974 | Slaybaugh | 16/51 |
| 4,050,114 | 9/1977 | Zunkel | 16/51 |

*Primary Examiner*—Ronald Feldbaum
*Attorney, Agent, or Firm*—Marvin L. Union

[57] ABSTRACT

A door closer for moving a door connected thereto from an open position to a closed position includes a housing, a chamber located within the housing, a piston movable in the chamber in response to movement of the door and a linkage assembly connected to the door for transmitting door movement from the door to the piston. A fluid chamber is disposed on one side of the piston and the piston moves through the fluid chamber upon closing movement of the door. Valve means is provided for controlling the rate of fluid flow from the fluid chamber as the piston moves therethrough to thereby control the rate of movement of the piston and the damping force acting on the door. A spring is disposed in the chamber and acts on the piston to provide a force to move the door toward the closed position. Means are provided for rendering the spring ineffective to bias the piston to move the door toward its closed position while allowing the door to close under a manual force exerted thereon while the closing rate of the door is controlled by the valve means controlling the rate of fluid flow therethrough from the fluid chamber. Such a construction allows the door to be under full control of a hydraulic fluid control system when the closing force exerted by the spring means is rendered ineffective.

18 Claims, 3 Drawing Figures

ZERO FORCE HOLD OPEN DOOR CLOSER

PRIOR ART STATEMENT

The following references are considered to be relevant to the present invention:

U.S. Pat. No. 4,010,572 — Peterson. The Peterson U.S. Pat. No. 4,010,572 discloses a means for pneumatically neutralizing the force of the spring in the closer while the door is being opened. The pneumatic forces established act to counter-balance the spring forces established by the main closer spring in the door closer.

BACKGROUND OF THE INVENTION

1. Field of the Invention

This invention relates to door closer assemblies and more particularly to a door closer wherein means are provided for rendering ineffective the main closer spring while maintaining the door under hydraulic control of the hydraulic circuit located in the door closer.

2. Description of the Prior Art

Known door closers utilize latching means to latch a closure member to prevent closure thereof by a main spring or the equivalent. When the latch is released, the closure closes under the force of the actuating means, which in most cases is a spring. An example of this type of operation is disclosed in the Bouton U.S. Pat. No. 1,888,712 which discloses a latch 34 which, when released by a solenoid 35, allows a gate to close under the force of an actuator. The Kaiser U.S. Pat. No. 767,346 also discloses a similar operation wherein a curtain is closed upon release of a counterbalance 17. Other art which discloses a similar type of operation include the Nole U.S. Pat. No. 944,494; the Schloss U.S. Pat. No. 1,430,192; and the Puhl U.S. Pat. No. 1,243,101. In all of the above cited patents, the closure member is not operable to be manually moved when the latch is actuated. The Peterson U.S. Pat. No. 4,010,572 discloses the use of a pneumatic cylinder for counteracting the force of the spring. However, in Peterson the counterbalancing of the spring by the pneumatic means only occurs at one point in the cycle of the closure. During the remainder of the cycle the spring will be effective to bias the door. Peterson does not disclose rendering the spring ineffective but rather discloses counterbalancing the spring force.

SUMMARY OF THE INVENTION

The present invention provides a door closer assembly for moving a door connected thereto from an open position toward a closed position including housing, a chamber located in the housing, biasing means disposed in the chamber to provide a restoring force to move the door toward its closed position and a piston slidable in the chamber in response to movement of the door. The piston is movable in a first direction against the force of the biasing means as the door moves toward an open position and is biased in a second direction, opposite the first direction, by the biasing means which normally biases the piston to urge the door toward its closed position. Means are provided for rendering the biasing means ineffective to exert the restoring force on the piston to bias the door toward its closed position.

Another provision of the present invention is to provide a new and improved door closer assembly for moving a door from an open position toward a closed position including a housing, a chamber disposed in the housing, a piston slidable in the chamber, a linkage assembly connected to the door for transmitting door movement from the door to the piston and spring means disposed in the chamber for acting on the piston to provide a restoring force to bias the piston and the linkage assembly to urge the door toward its closed position. The linkage assembly is operable to effect movement of the piston in a first direction in the chamber upon opening movement of the door against the restoring force of the spring means and the spring means is operable to bias the piston in the chamber in a second direction, opposite the first direction, to effect movement of the piston and linkage to move the door toward its closed position. Means are provided for rendering the spring means ineffective to bias the piston in the second direction to move the door toward its closed position.

Still another provision of the present invention is to provide a new and improved door closer assembly for moving a door connected thereto from an open position to a closed position, including a housing, a chamber located in the housing, a piston movable in the chamber, a linkage assembly connectable to the door for transmitting door movement from the door to the piston, a fluid chamber located on one side of the piston and through which the piston must move upon closing of the door, and valve means for controlling the rate of fluid flow from the fluid chamber as the piston moves therethrough to thereby control the rate of movement of the piston and, hence, control the damping force acting on the door. The door closer assembly further includes biasing means acting on the piston and providing a force to move the door toward the closed position and means for rendering the biasing means ineffective to bias the piston to move the door toward its closed position while allowing the door to close under a manual force exerted thereon while the damping force resisting closure of the door is controlled by the valve means controlling the rate of fluid flow therethrough from the fluid chamber.

DESCRIPTION OF THE PREFERRED EMBODIMENT

Figure 1:
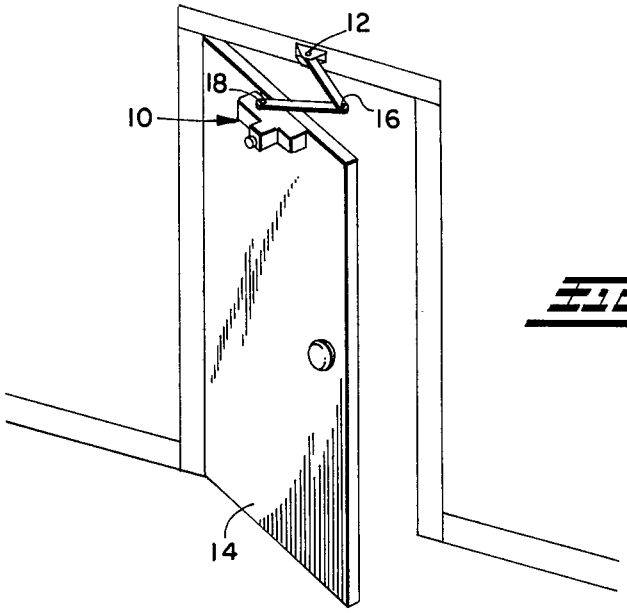
FIG. 1 is a schematic representation of the door closer of the present invention mounted to a door assembly.

Referring to the drawings, the door closer 10 of the present invention is illustrated. The door closer 10 is shown mounted to the top of the door 14 but may also be mounted on the top jam of the door 14 in a well-known manner. The door closer 10 senses the movement of the door 14 through the movement of a linkage 16 which may be affixed either to the door jamb 12 or the door 14 at one end, depending upon the mounting of the door closer 10, and to a pinion shaft 18 of the door closer 10 at the other end. Movement of the door 14 will be transferred through the linkage 16 to the pinion 18 of the door closer 10 in a well-known manner.

Figure 2:
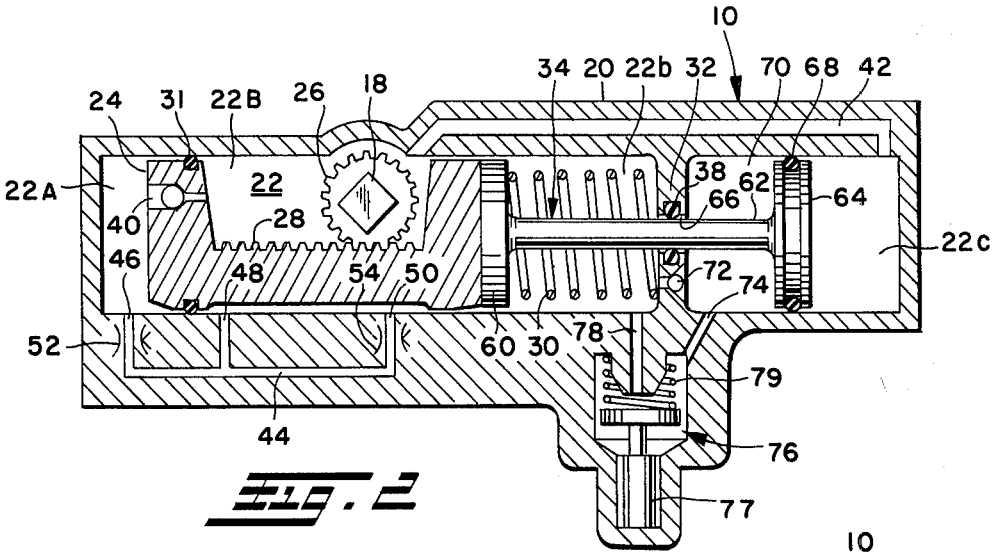
FIG. 2 is a schematic cross-sectional illustration of the door closer of the present invention illustrating the device in the door closed position.
Figure 3:
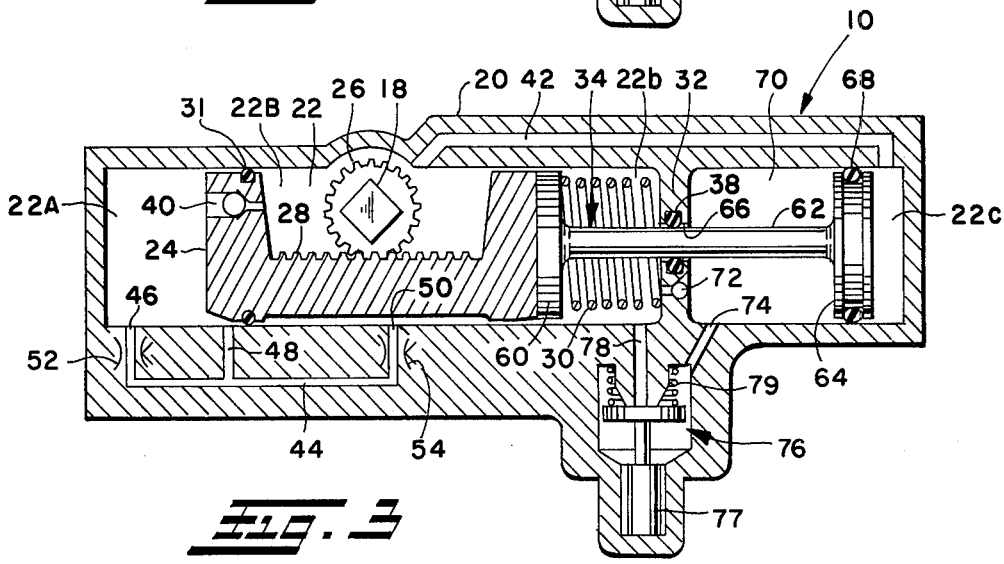
FIG. 3 is a schematic cross-sectional illustration similar to that disclosed in FIG. 2 but illustrating the door closer in its door open position.

Referring more particularly to FIGS. 2 and 3, the door closer 10 of the present invention includes a body 20 which defines a chamber 22 therein. A piston 24 is slidably disposed in chamber 22 and includes a rack portion having teeth 28 thereon. The pinion 18 includes a pinion gear having teeth 26 which mesh with the teeth 28 disposed on the piston 24. The pinion 18 and piston 24 form a rack and pinion assembly and rotation of the pinion 18 by the linkage 16 upon movement of the door 14 will effect a corresponding movement of the piston 24 as is well known in the art.

A main closer spring 30 is disposed between an annular shoulder 32 formed in the wall of the piston housing 20 and a spring retainer 34. The main closer spring 30 is in compression and exerts a force against the spring retainer 34 to bias the retainer 34 toward the left, as is illustrated in FIGS. 2 and 3, to bias the spring retainer 34 into engagement with the main piston 24. The spring 30 acts through the spring retainer 34 to exert a biasing force to bias the piston 24 toward the left to exert a restoring force on the piston 24 to move the door 14 toward its closed position.

Upon opening movement of the door, the linkage 16 effects counterclockwise rotation of the pinion 18 to effect movement of the piston 24 toward the right as is illustrated in the figures. Movement of the piston 24 toward the right effects movement of the spring retainer 34 toward the right and compression of the spring 30. When the door is released, the potential energy stored in spring 30 exerts a restoring force on the spring retainer 34 to bias the retainer 34 and the piston 24 toward the left as is illustrated in FIGS. 2 and 3. Movement of the piston 24 to the left effects clockwise rotation of the pinion 18 and closing of the door via the linkage 16.

A hydraulic control system is provided to control the rate of movement of the piston 24 through the chamber 22 under the influence of the spring 30. To this end the chamber 22 is generally filled with hydraulic fluid. An O ring 31 is disposed around one end of the piston 24 to provide a sealing relationship between the piston 24 and the wall of chamber 22. The O ring divides the reservior 22 into two portions, as illustrated in the figures, **22*a*, to the left of O ring 31 and 22*b* to the right of O ring 31. A further portion 22*c* of chamber 22 is provided in the right end of the body 20 as will be more fully described herein below. The portion 22*b* of chamber 22 is sealed at one end by an annular O ring seal 38 which is disposed on the annular shoulder 32. The O ring 38 engages the spring retainer 34 in a sealing engagement. Thus, chamber 22*a* is defined by one end wall of the housing 20 and the O ring 31 and chamber 22*b* is defined between the O ring 31 and the O ring 38. The end of piston 24 on which O ring 31 is not disposed is not in a sealing relationship with the wall of chamber 22 and, hence, hydraulic fluid freely flows past the right head of piston 24** as viewed in the drawings.

The hydraulic control system includes a one-way valve 40 disposed in the left end of the piston 24, as illustrated, for providing fluid flow from the chamber **22*b* to the chamber 22*a*. A sweep and latch circuit 44 is provided to control the rate of closing movement of the door 14. The circuit 44 includes a latch passageway 46, a sweep passageway 48, and an exit passageway 50 which are interconnected by the passageway 44** in a well-known manner.

Upon opening movement of the door 14 the piston 24 will move toward the right from its position shown in FIG. 2 to its position shown in FIG. 3. Fluid will be allowed to flow through the passageway 40 from chambers **22*b* and 22*c* to 22*a* as chamber 22*a* expands and chambers 22*b* and 22*c* contract upon movement of the piston 24 to the right. Movement of the piston 24 upon door opening movement will also slide the spring retainer 34 toward the right, as viewed in the figures, and compress the main closing spring 30** as will be described more fully herein below.

When the door 14 is released, the main closer spring 30 acting via the spring retainer 34 will bias the piston 24 from its position shown in FIG. 3 toward its position shown in FIG. 2 to effect closing of the door. As the piston 24 slides toward the left under the influence of spring 30, fluid flow will be prevented via the passageway 40 from the chambers **22*a* to 22*b*. Since chamber 22*a* is contracting and chambers 22*b* and 22*c* are expanding as the piston 24 moves toward a door closed position, the fluid in chamber 22*a* must pass through the latch and sweep circuits 44 as chamber 22*a* decreases in volume. When the door starts to close, the speed of movement of piston 24 will be relatively rapid as fluid can exit chamber 22*a* from both passageways 46 and 48. However, when the door is almost fully closed the sweep passageway 48 will be covered by the head of the piston 24 and passageway 48 will no longer provide for fluid flow from the chamber 22*a*. At this point fluid flow from chamber 22*a* will only occur through the latch passageway 46. This will control the speed of movement of the piston 24 and the door 14 by further restricting or unrestricting fluid flow from the chamber 22*a*. Latch passageway 46 will continue to control the damping force on door 14 and piston 24 until door 14 latches and piston 24 stops. Suitable restrictor valves 52 and 54 are provided in passageways 46 and 50**, respectively, to provide for adjustment of the control of fluid flow through the sweep and latch passageways in a well-known manner.

The spring retainer 34 includes a T-shaped end portion 60, a necked down intermediate portion 62, and a T-shaped piston head 64. The end 60 of the spring retainer 34 is interposed between one end of the main closer spring 30 and one end of the piston 24 and acts to transfer the biasing force of the spring 30 to the main piston 24. The intermediate portion 62 of the spring retainer 34 extends through an opening 66 in the annular shoulder 32. The O ring seal 38 engages the outer peripheral surface of the intermediate portion 62 to provide a sealing relationship between the portion 62 and the annular shoulder 32. The piston head 64 of the spring retainer 34 includes an O ring 68 disposed therein which is in a sealing relationship with the walls of the housing 20. The annular shoulder 32 and the piston head 64 cooperate to define a variable volume fluid chamber 70. The volume of fluid chamber 70 varies with the position of the piston head 64. Chamber 70 normally expands upon movement of piston 24 to the right upon door opening movement and normally contracts upon movement of the piston to the left upon door closing movement. Chamber **22*c* is disposed on the opposite side of piston head 64 as is chamber 70. Chamber 22*c* has a variable volume which depends on the position of piston head 64. Chamber 22*c* normally contracts upon movement of the piston head 24 to the right upon door opening movement and normally expands upon movement of the piston to the left upon door closing movement. A passageway 42 connects chamber 22*c* with chamber 22*b* to provide for fluid flow therebetween. Fluid flows from 22*b* to 22*c* upon expansion of 22*c* during door opening movement and flows from 22*c* to 22*b*** upon contraction of 22*c* during door opening movement.

A hydraulic circuit is provided to control the fluid flow between the chamber 22*b* and the chamber 70. To this end, a one-way check valve 72 is disposed in the annular shoulder 32. The one-way check valve 72 provides for fluid flow from the chamber 22*b* into the chamber 70 upon door opening movement and expansion of chamber 70. Check valve 72 prevents fluid flow from the chamber 70 into the chamber 22*b*. Fluid flow from chamber 70 to chamber 22*b* is directed through a passageway 74, through a valve 76 to a passageway 78 which directs the fluid flow into chamber 22*b*. When the valve 76 is opened, fluid flow will be provided from chamber 70 into chamber 22*b* upon closing movement of the door 14 and contraction of chamber 70. When the valve 76 is closed, fluid will be trapped in chamber 70, as passageway 78 will no longer provide for fluid flow into chamber 22 and check valve 72 will close preventing fluid flow from chamber 70 to chamber 22*b*. An actuator 77, which may preferably be pneumatically, electrically, or manually operated, is provided for closing valve 76 and spring 79 is provided for opening valve 76 when actuation 77 is not energized.

Upon opening movement of the door, the piston 24 will slide toward the right as illustrated in the figures, moving the spring retainer 34 toward the right and compressing the main closer spring 30. As piston 24 moves toward the right, chamber 22*b* will become smaller and chamber 70 will increase in size as the piston head 64 of spring retainer 34 is moved toward the right. This will effect a fluid flow from chamber 22*b* to chamber 70 through the check valve 72 to insure that chamber 70 remains filled with hydraulic fluid as the chamber expands. When the door is released, the main closer spring 30 will act via the spring retainer 34, to bias the piston 24 toward the left to effect closing of the door. As the spring 30 expands and piston 24 moves toward the left, chamber 22*b* will increase in volume while chamber 70 decreases in volume. Fluid flow will then flow from chamber 70 through passageway 74, through valve 76, through passageway 78 into chamber 22*b*. If valve 76 is closed, fluid will be trapped in chamber 70 prohibiting movement of piston head 64 toward the left and the spring retainer 34 will not be permitted to move toward the left under the influence of the spring 30. Thus, closing of the valve 76 will render the spring 30 ineffective to bias the main piston 24 and close the door.

When valve 76 is closed and the spring retainer 34 physically restrains the spring 30, the spring will be rendered ineffective to bias portion 24. However, piston 24 will be movable in chamber 22 via linkage 16 in response to a manual movement of the door 14. Thus, if valve 76 is energized and closed, the door 14 can be closed by exerting a manual force thereof to effect closing thereof. The manual force exerted on the door 14 will rotate the pinion 18 and effect movement of the piston 24 toward the left to its door closed position, as is illustrated in FIG. 2. Movement of the piston 24 to the left as viewed in the figures will not effect movement of the spring retainer 34 and spring 30 and they will remain in their position shown in FIG. 3 until valve 76 is opened. Hydraulic control of the main piston 24 will still be effective as the sweep and latch circuit 44 will still control fluid flow from the chamber 22*a* to the chamber 22*b* even though the spring has been rendered ineffective by the closing of valve 76. Thus, the door is under full control of a hydraulic speed control system when the main closing spring 30 is rendered ineffective to bias the piston 24 and the door 14. Such a control system allows the door 14 to be opened to any point, the valve 76 to be closed and the door will stay at that position until a force is exerted on the door to effect closing thereof. If the door is moved, it remains under full hydraulic control via the hydraulic control circuit 44. When the control valve 76 is again opened, the closing force of the spring 30 is applied to the piston 24 to close the door under hydraulic control.

While a hydraulic configuration has been disclosed for trapping the closer spring 30 by the spring retainer 34, it should be appreciated that various other methods could be utilized to render the spring means 30 ineffective to bias the piston 24. Such other means could be either mechanical or electrical means for physically restraining the spring 30.

From the foregoing it should be apparent that a new and improved door closer has been provided for moving a door connected thereto from an open position to a closed position which includes housing, a chamber located within the housing, and piston movable in the chamber in response to movement of the door. A fluid chamber is provided and valve means control the rate of fluid flow from the fluid chamber as the piston moves therethrough to thereby control the rate of movement of the piston and the damping force acting on the door. A closer spring is provided to act on the piston and provide a force to move the door toward the closed position. Means for rendering the closer spring ineffective to bias the piston are also provided. The means for rendering the spring means ineffective does not effect the hydraulic control of the main piston. Thus, a door closer has been provided wherein the closing force exerted by the main closer spring can be removed while allowing the door to be under full control of a hydraulic control circuit.

I claim:

1. A door closer assembly for moving a door connected thereto from an open position toward a closed position comprising a housing, a chamber located in said housing, biased means disposed in said chamber providing a restoring force to move the door toward its closed position, a piston slidable in said chamber in response to movement of the door, said piston being movable in a first direction against the force of said biasing means as the door moves toward an open position and being biased in a second direction, opposite said first direction, by said biasing means which normally biases the piston to urge the door towards its closed position, and means for rendering said biasing means ineffective to exert said restoring force on said piston to bias the door toward its closing position.

2. A door closer assembly for moving a door connected thereto from an open position toward a closed position comprising a housing, a chamber located in said housing, biasing means disposed in said chamber providing a restoring force to move the door toward its closed position, a piston slidable in said chamber in response to movement of the door, said piston being movable in a first direction against the force of said biasing means as the door moves toward an open position and being biased in a second direction, opposite said first direction, by said biasing means which normally biases the piston to urge the door towards its closed position, and means for rendering said biasing means ineffective to exert said restoring force on said piston to bias the door toward its closing position, said means for rendering said biasing means ineffective to bias said piston comprises means for physically restraining said biasing means to prevent said biasing means from biasing said piston.

3. A door closer assembly as defined in claim 2 wherein said biasing means includes a spring and said means for rendering said biasing means ineffective includes a spring retainer, said spring retainer being interposed between one end of said spring and one end of said piston for transferring the biasing force of said spring to said piston.

4. A door closer assembly as defined in claim 3 wherein said spring retainer is movable relative to said housing to transfer said biasing force of said spring to said piston and wherein said means for rendering said biasing means ineffective further includes means for rendering said spring retainer immovable relative to said chamber to physically restrain said spring and prevent said spring retainer from transferring said biasing force of said spring to said piston.

5. A door closer assembly as defined in claim 4 wherein said spring retainer includes piston means associated therewith, said piston means being movable in response to movement of said spring retainer and wherein said means for rendering said spring retainer immovable relative to said chamber includes hydraulic means for hydraulically restraining said piston means to physically restrain said spring retainer and said spring.

6. A door closer as defined in claim 5 wherein said hydraulic means includes a hydraulic circuit through which hydraulic fluid must flow in response to movement of said piston means and valve means for preventing the flow of hydraulic fluid through said hydraulic circuit to prevent movement of said piston means and said spring retainer associated therewith.

7. A door closer assembly for moving a door connected thereto from an open position to a closed position comprising, a housing, a chamber located within said housing, a piston movable in said chamber in response to movement of the door, a linkage assembly connectable to the door for transmitting door movement from the door to said piston, a fluid chamber located on one side of said piston and through which said piston must move upon closing of the door, valve means for controlling the rate of fluid flow from said fluid chamber as said piston moves therethrough to thereby control the rate of movement of said piston and, hence, control the damping force acting on the door, biasing means acting on said piston and providing a force to move the door toward the closed position and means for rendering said biasing means ineffective to bias said piston to move the door toward its closed position while allowing the door to close under a manual force exerted thereon while the damping force resisting closure of the door controlled by said valve means controls the rate of fluid flow therethrough from said fluid chamber.

8. A door closer assembly for moving a door connected thereto from an open position to a closed position comprising, a housing, a chamber located within said housing, a piston movable in said chamber in response to movement of the door, a linkage assembly connectable to the door for transmitting door movement from the door to said piston, a fluid chamber located on one side of said piston and through which said piston must move upon closing of the door, valve means for controlling the rate of fluid flow from said fluid chamber as said piston moves therethrough to thereby control the rate of movement of said piston and, hence, control the damping force acting on the door, biasing means acting on said piston and providing a force to move the door toward the closed position and means for rendering said biasing means ineffective to bias said piston to move the door toward its closed position while allowing the door to close under a manual force exerted thereon while the damping force resisting closure of the door controlled by said valve means controls the rate of fluid flow therethrough from said fluid chamber, said means for rendering said biasing means ineffective to bias said piston comprises means for physically restraining said biasing means to prevent said biasing means from biasing said piston.

9. A door closer assembly as defined in claim 8 wherein said biasing means includes a spring and said means for rendering said biasing means ineffective includes a spring retainer, said spring retainer being interposed between one end of said spring and one end of said piston for transferring the biasing force of said spring to said piston.

10. A door closer assembly as defined in claim 9 wherein said spring retainer is movable relative to said housing to transfer said biasing force of said spring to said piston and wherein said means for rendering said biasing means ineffective further includes means for rendering said spring retainer immovable relative to said chamber to physically restrain said spring and prevent said spring retainer from transferring said biasing force of said spring to said piston.

11. A door closer assembly as defined in claim 10 wherein said spring retainer includes piston means associated therewith, said piston means being movable in response to movement of said spring retainer and wherein said means for rendering said spring retainer immovable relative to said chamber includes hydraulic means for hydraulically restraining said piston means to physically restrain said spring retainer and said spring.

12. A door closer as defined in claim 11 wherein said hydraulic means includes a hydraulic circuit through which hydraulic fluid must flow in response to movement of said piston means and second valve means for preventing the flow of hydraulic fluid through said hydraulic circuit to prevent movement of said piston means and said spring retainer associated therewith.

13. A door closer assembly connectable to a door for moving the door from an open position to a closed position comprising, a housing, a chamber disposed in said housing, a piston slidable in said chamber in response to movement of the door, a linkage assembly connectable to the door for transmitting door movement from the door to said piston, spring means disposed in said chamber and acting on said piston for providing a restoring force to bias said piston and said linkage assembly to urge the door toward its closed position, said linkage assembly being operable to effect movement of said piston in a first direction in said chamber upon opening movement of said door against said restoring force of said spring means, said spring means being operable to bias said piston in said chamber in a second direction, opposite said first direction, to effect movement of said piston and said linkage to move the door toward its closed position, and means for rendering said spring means ineffective to bias said piston in said second direction to move the door toward its closed position.

14. A door closer assembly connectable to a door for moving the door from an open position to a closed position comprising, a housing, a chamber disposed in said housing, a piston slidable in said chamber in response to movement of the door, a linkage assembly connectable to the door for transmitting door movement from the door to said piston, spring means disposed in said chamber and acting on said piston for providing a restoring force to bias said piston and said linkage assembly to urge the door toward its closed position, said linkage assembly being operable to effect movement of said piston in a first direction in said chamber upon opening movement of said door against said restoring force of said spring means, said spring means being operable to bias said piston in said chamber in a second direction, opposite said first direction, to effect movement of said piston and said linkage to move the door toward its closed position, and means for rendering said spring means ineffective to bias said piston in said second direction to move the door toward its closed position, said means for rendering said spring means ineffective to bias said piston comprises means for physically restraining said spring means to prevent said biasing means from biasing said piston.

15. A door closer assembly as defined in claim 14 wherein said means for rendering said spring means ineffective includes a spring retainer, said spring retainer being interposed between one end of said spring means and one end of said piston for transferring the biasing force of said spring means to said piston.

16. A door closer assembly as defined in claim 15 wherein said spring retainer is movable relative to said housing to transfer said biasing force of said spring means to said piston and wherein said means for rendering said biasing means ineffective further includes means for rendering said spring retainer immovable relative to said chamber to physically restrain said spring means and prevent said spring retainer from transferring said biasing force of said spring means to said piston.

17. A door closer assembly as defined in claim 16 wherein said spring retainer includes piston means associated therewith, said piston means being movable in response to movement of said spring retainer and wherein said means for rendering said spring retainer immovable relative to said chamber includes hydraulic means for hydraulically restraining said piston means to physically restrain said spring retainer and said spring means.

18. A door closer as defined in claim 17 wherein said hydraulic means includes a hydraulic circuit through which hydraulic fluid must flow in response to movement of said piston means and valve means for preventing the flow of hydraulic fluid through said hydraulic circuit to prevent movement of said piston means and said spring retainer associated therewith.

* * * * *